US006367925B1

(12) United States Patent
Chen et al.

(10) Patent No.: US 6,367,925 B1
(45) Date of Patent: Apr. 9, 2002

(54) FLAT-SIDED FLUID DISPENSING DEVICE

(75) Inventors: Ting Chen, Richardson; Donald J. Hayes, Plano, both of TX (US)

(73) Assignee: MicroFab Technologies, Inc., Plano, TX (US)

( * ) Notice: Subject to any disclaimer, the term of this patent is extended or adjusted under 35 U.S.C. 154(b) by 0 days.

(21) Appl. No.: 09/514,760

(22) Filed: Feb. 28, 2000

(51) Int. Cl.[7] ..... B41J 3/36; B41J 2/045
(52) U.S. Cl. ..... 347/109; 347/38
(58) Field of Search ..... 347/109, 68, 84; 422/100

(56) References Cited

U.S. PATENT DOCUMENTS

| | | | | |
|---|---|---|---|---|
| 3,683,212 | A | | 8/1972 | Zoltan |
| 3,946,398 | A | | 3/1976 | Kyser et al. |
| 3,972,474 | A | | 8/1976 | Keur |
| 4,418,354 | A | | 11/1983 | Perduijn |
| 4,828,886 | A | | 5/1989 | Hieber |
| 4,887,100 | A | | 12/1989 | Michaelis et al. |
| 5,053,100 | A | | 10/1991 | Hayes et al. |
| 5,227,813 | A | | 7/1993 | Pies et al. |
| 5,235,352 | A | | 8/1993 | Pies et al. |
| 5,415,679 | A | | 5/1995 | Wallace |
| 5,498,444 | A | | 3/1996 | Hayes |
| 5,681,747 | A | | 10/1997 | Hayes |
| 5,772,106 | A | | 6/1998 | Ayers et al. |
| 5,838,350 | A | * | 11/1998 | Newcombe et al. ..... 347/68 |
| 5,958,342 | A | * | 9/1999 | Gamble et al. ..... 422/100 |

* cited by examiner

*Primary Examiner*—Thinh Nguyen
(74) *Attorney, Agent, or Firm*—Locke Liddell & Sapp LLP

(57) ABSTRACT

A low cost digitally operated dispenser apparatus and method of operation and construction is obtained by combining flat sided, preferably rectangular tubular capillary tube having an orifice, with a flat elongated strip of piezoelectric material. Microdroplets are dispensed from an internal chamber within the capillary tube, or a separate feed supply, upon application of voltage pulses through electrodes connected to conductive layers on the piezoelectric material. The piezoelectric strip may be parallel to the flat capillary tube or perpendicular to it. On a variation, a fixture can be used to improve performance in combination with the capillary tube and piezoelectric strip. A standoff strip allows the piezoelectric operator to be thermally isolated from a flat rectangular capillary tube.

33 Claims, 6 Drawing Sheets

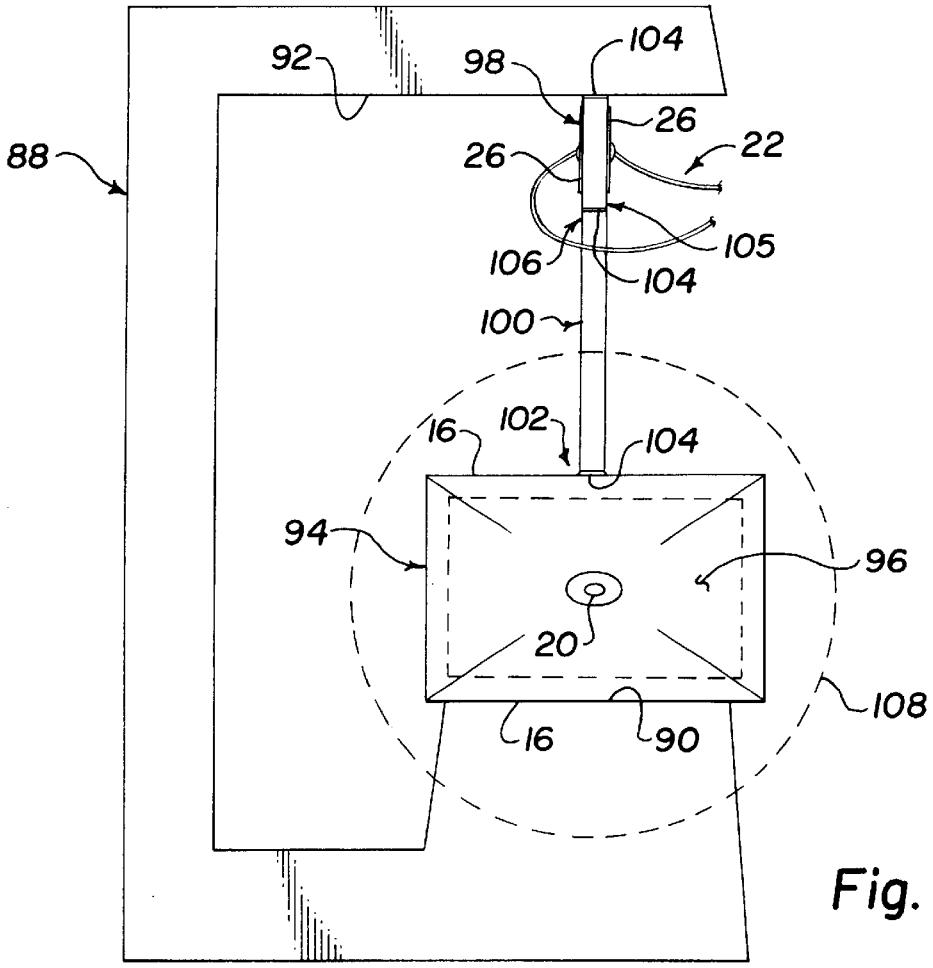
Fig. 20
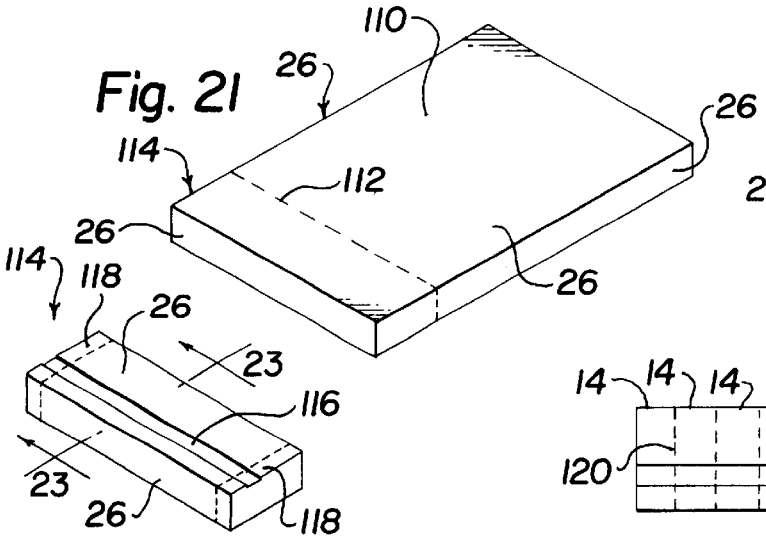
Fig. 21
Fig. 22
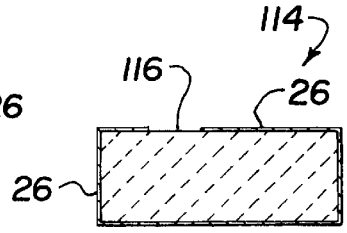
Fig. 23
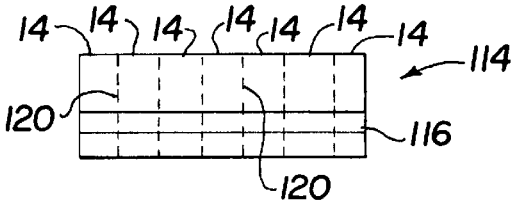
Fig. 24

FLAT-SIDED FLUID DISPENSING DEVICE

BACKGROUND OF THE INVENTION

1. Field of the Invention

The invention is a functional digital dispenser for microdroplets that has significantly lower material and assembly cost.

2. Background of the Prior Art

Digitally operated microdroplet dispensing devices are well known in the prior art as they are employed in ink jet printing heads. They are usually fabricated with liquid containing channels capped with orifice plates having an array of orifices in fluid communication with the channels. The channels are frequently precision machined from blocks of piezoelectric material which are specially treated with conductive and/or non-conductive coatings which allow individual channels to be "fired" as a result of mechanical and acoustical effects on the liquid contained in the channels created by voltage pulses applied to contacts on the various piezoelectric sidewalls. Some examples of this are Michaelis et al., U.S. Pat. No. 4,887,100 (1989); Pies, Wallace and Hayes, U.S. Pat. No. 5,227,813 (1993); and Pies, Wallace and Hayes, U.S. Pat. No. 5,235,352 (1993) the disclosures of which are hereby incorporated by reference. Although these ink jet printing heads are mass-produced, they remain relatively expensive because of the high cost of the piezoelectric material and processing.

The prior art has recognized the desirability to producing individual pulsed microdroplet ejection devices that are sometimes referred to as "jetting" devices. Examples of these individualized electronically controllable pulse droplet ejection devices are found in Zoltan, U.S. Pat. No. 3,863,212 (1972); Keur, U.S. Pat. No. 3,972,474 (1976); Perduijn, U.S. Pat. No. 4,418,354 (1983); Hieber, U.S. Pat. No. 4,828,886 (1989); and Hayes et al., U.S. Pat. Nos. 5,053,100 (1991), and U.S. Pat. No. 3,946,398 the disclosures of which are incorporated by reference herein.

The heart of the individual devices is a very fine circular capillary tube drawn to tiny orifice and surrounded by a generally tubular shaped driver positioned around and in operative contact with the capillary tube. The driver device generates a pressure wave in liquid contained in the capillary tube, which produces successive microdroplets in response to electrical voltage pulses. The most practical driver device for such unitary dispensers is cylindrical piezoelectric material which itself may contain or act as a liquid chamber in communication with the liquid to be dispensed. In essence, the piezoelectric material is itself a tube and has heretofore been fabricated by processes such as machining, extrusion or some form of molding. However, the nature of the material makes such specialty tubular cylindrical shaped piezoelectric material relatively expensive.

There are constraints on the adhesive which can be employed to bond the piezoelectric tube to the round capillary tube. The viscosity must be low enough allowing the adhesive to flow into the contact area. It is especially difficult (expensive) to find a suitable low viscosity adhesive if the dispenser is to be used at elevated temperature. These factors also affect cost.

It would be highly desirable to find a structure which substantially reduces the material and fabrication costs of individual dispensers which can be used with a limited supply of fluid in applications where the device itself can be discarded after the fluid is dispensed. One example would be dispensing perfume.

SUMMARY OF THE INVENTION

The invention accomplishes the goal of low cost disposability in a device for ejecting microdroplets of fluid materials by utilizing the combination of a flat or flattened capillary tube and a preferably rectangular cross sectioned elongated strip of piezoelectric material which comprises a portion of piezoelectric material severed from a sheet of piezoelectric material. Piezoelectric material in sheet form is available at a small fraction of the cost of conventional cylindrical shaped piezoelectric actuators.

A flat-sided elongated capillary tube having an orifice at one end is provided with a liquid to be dispensed from a capillary tube, a portion of the liquid being in fluid communication with the orifice. The liquid can be provided as self-contained within the flat sided capillary tube. The liquid can also be provided from a separate reservoir which is in fluid communication with the non-orifice end of the capillary tube. An elongated strip of piezoelectric material is bonded to a flat side of the capillary tube and provided with a connection for drive electronics whereby a series of voltage pulses can be cyclically applied to the piezoelectric material thereby causing dimensional changes in the piezoelectric material and acoustical effects which operate on the liquid in the capillary tube such that droplets of the liquid are dispensed from the orifice of the capillary tube in response to the cyclically applied voltage pulses.

In one form of the dispensing device, the strip of piezoelectric material has nearly the same width as the flat side of the capillary tube and lies generally parallel to it and against it. In another form of the dispensing device, the strip of piezoelectric material lies generally perpendicular to a flat side of the capillary tube with one of the narrow edges bonded, preferably near the centerline, to the flat side of the flat-sided capillary tube. When looked at from the front, or in cross section, this latter construction appears in the form of an inverted "T". The flat-sided capillary tube forms the cross bar of the "T" and the piezoelectric strip comprises the stem of the "T". A further improvement is provided by the perpendicularly mounted piezoelectric strip. The capillary tube is mounted on a support surface and the upper edge of the "T"-shaped structure is stopped against another support surface. The efficiency of movement of the piezoelectric strip with respect to the capillary tube is improved in this configuration when cyclical voltage pulses are applied to the piezoelectric strip of an intensity and duration sufficient to dispense droplets of dispensing liquid from the orifice. Performance of the combination of the flat-sided capillary tube with an orifice in one end and the elongated strip of piezoelectric material bonded to the flat side of the capillary tube has been found to be enhanced if the capillary tube is preferably fixedly mounted within an open sided ("U"-shaped) fixture. The fixture does not necessarily have to be open sided, since all that is required is that the piezoelectric material remain unconstrained within the structure. In this form of the combination, it has been found that operating stability is improved and the droplets can be ejected at lower voltages applied to the piezoelectric material.

A still further embodiment is a combination of a fixture having spaced-apart opposing support surfaces, a flat sided capillary tube having an orifice at one end partly disposed on one support surface of the fixture, and a strip of piezoelectric material coupled between the other of the support surfaces of the fixture and a flat side of the capillary tube wherein the strip of piezoelectric material includes a stand-off strip portion having one edge connected to the piezoelectric strip and an opposite edge coupled to the flat side of the capillary tube to permit operation of the capillary tube at elevated temperature without depoling the piezoelectric material which is driving it. For example, the capillary tube and part of the fixture could be mounted in the heating chamber with the inactive stand-off strip portion extending from the heating chamber in direct connection with a corresponding strip portion of active piezoelectric material which is backed by another portion of the fixture or a different fixture and whereby movement of the piezoelectric strip is transferred by the stand-off strip portion directly to a flat side of a capillary tube.

The combination of a flat-sided capillary tube and a strip of piezoelectric material in operative contact with the flat side of the capillary tube, wherein the capillary tube has an orifice and a dispensing liquid to be dispensed, is accomplished by applying cyclical voltage pulses to electrodes on the piezoelectric strip, the pulses being of an intensity and duration sufficient to dispense droplets of dispensing liquid from the orifice. The piezoelectric strip may be edge mounted along one edge of the piezoelectric material generally perpendicular to said flat side of the capillary tube material whereby the strip of piezoelectric material has a free edge opposite the mounted edge, and the dispensing device is operated by applying cyclical voltage pulses to the piezoelectric strip while the free edge of the piezoelectric strip is restrained. The dispenser may be operated by providing a fixture having spaced-apart support surfaces, mounting the flat-sided capillary tube in one of the support surfaces and the step of providing a strip of piezoelectric material in operative contact with a flat side of the tube may be performed by providing a stand-off strip in contact with the flat side of the capillary tube between the piezoelectric strip and the other support surface of the fixture, and supporting the piezoelectric strip by said other supporting surface of the fixture whereby action produced by cyclical voltage pulses applied to the piezoelectric strip is transferred to the capillary tube by the stand-off strip.

The invention also includes a method of constructing a low cost dispensing device of the type having a capillary tube having a dispensing orifice wherein the capillary tube is in intimate contact over an extended portion of its length with a piezoelectric actuator connected to drive electronics in a power supply capable of operating the piezoelectric actuator by means of cyclical voltage pulses with sufficient intensity and duration, wherein the improvement comprises providing the capillary tube as a flat sided tube, providing the piezoelectric actuator as a flat strip of piezoelectric material, bonding the flat sided piezoelectric material to the flat side of the capillary tube and providing electrical contacts to conductive coating on the piezoelectric material whereby droplets of dispensing liquid may be dispersed from the orifice in response to application of said voltage pulses to said piezoelectric material.

The method of construction includes cutting the flat strip of piezoelectric material from a larger sheet of the piezoelectric material which preferably has been previously provided with an electrically conductive coating layer which will serve as a basis for attachment of electrode wires to operate the dispensing device after the flat strip is cut from the sheet. The larger strip of piezoelectric material is cut to produce an intermediate long flat strip of piezoelectric material having the electrically conductive coating and whereby a portion of the electrically conductive coating is removed by suitable process. The piezoelectric actuator is selected from a plurality of said flat strips obtained by cross cutting them from the intermediate long flat strip. The method of operating further includes operating the piezoelectric strip, flat sided tube combination, by providing a "U"-shaped support for the capillary tube and operating the dispenser to dispense liquid droplets by means of voltage pulses which are applied to the piezoelectric strip while the capillary tube is supported by the "U"-shaped support.

BRIEF DESCRIPTION OF THE DRAWINGS

FIG. 20 is a schematically represented embodiment in which the active piezoelectric actuator is connected to a flat-sided tube by an inactive stand-off strip and backed by a fixture whereby elevated temperature may be applied to the flat sided capillary tube in operation without depoling the piezoelectric actuator driver;

FIG. 21 is a perspective view of a sheet of inexpensive piezoelectric material which is severed to produce the raw material for FIG. 22;

FIG. 22 illustrates the severed portion of the inexpensive piezoelectric sheet with a portion of the outer conductive coating removed;

FIG. 23 is a cross sectional view of the partially fabricated stock of FIG. 22 along the lines 23—23;

FIG. 24 shows how individual elongated flat strips of piezoelectric material, which are useful for the first embodiment of FIG. 1 can be economically produced.

DETAILED DESCRIPTION

Figure 1:
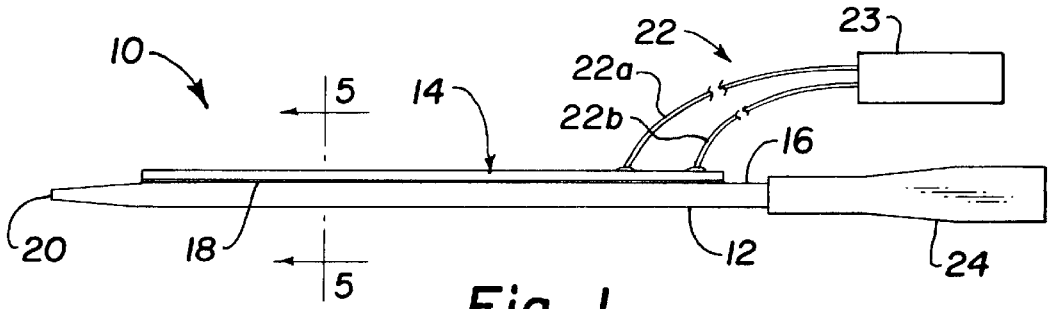
FIG. 1 is a side elevation of a first embodiment of the low cost fluid dispensing device showing a flat strip of piezoelectric material bonded to the flat side of a capillary.

In the description that follows, like structures will be assigned the same reference numerals. Reference numerals with a "prime" are used to indicate substantial similarity with some deviation from an embodiment previously described.

In FIG. 1, low cost dispenser 10 includes a flat sided elongated capillary tube 12 and a flat elongated strip 14 bonded to a flat side 16 by means of a layer of adhesive 18. Capillary tube 12 has a finely drawn orifice 20 for dispensing droplets of fluid therefrom. Piezoelectric strip 14 has a pair of electrodes 22 comprising electrodes 22*a*, 22*b*. A powered control 23 includes driving electronics for applying appropriate cyclical voltage pulses to the piezoelectric material 14 to create the conditions in capillary tube 12 conducive to jetting drops of dispensing liquid from orifice 20. This is preferably accomplished with a small "chip" or several "chips" and a small battery in control 23. A connection 24 may lead to a reservoir of dispensing fluid or dispensing fluid may be contained in the capillary tube itself.

Figure 2:
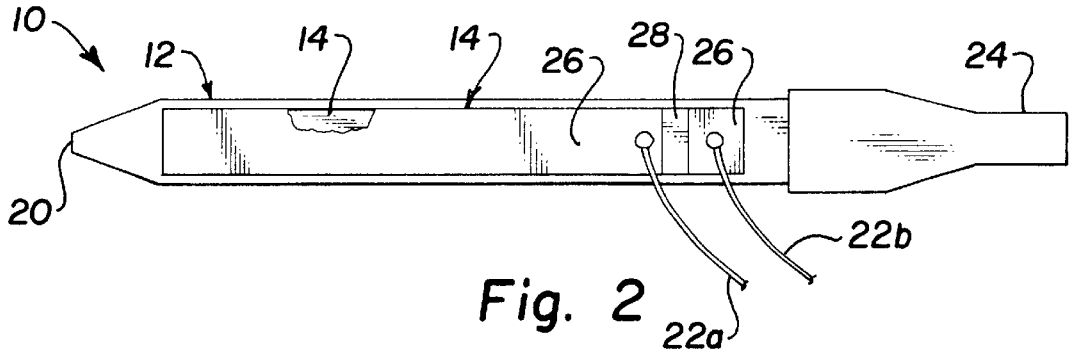
FIG. 2 is a top plan view of the low cost dispensing device of FIG. 1.

FIG. 2 shows a view of the structure of FIG. 1 looking down on piezoelectric strip 14, which is nearly as wide as flat tube 12. The electrodes 22*a* and 22*b* are shown to be connected to a vertically shaded area which comprises a preferably metallic conductive coating 26 which is indicated by the vertical shading in FIG. 2. A strip 28 of bare piezoelectric material 14 separates the coated portions 26 so that a positive voltage can be applied across both surfaces of the piezoelectric material 14 which itself is relatively non-conductive. Typical piezoelectric material for this application is a lead zirconate titanate material known as PZT, lithium niobate or even quartz crystal. A better understanding of the conductive surface arrangement is seen in the cross section of piezoelectric strip 14 in FIG. 3, somewhat enlarged in size.

Figure 4A:
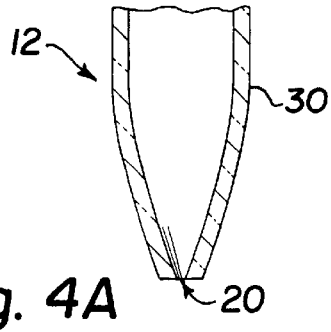
FIG. 4 is a cut away cross section showing a typical orifice produced by drawing a rectangular glass capillary tube as found in the previous figures.
Figure 4B:
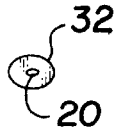
Figure 5:
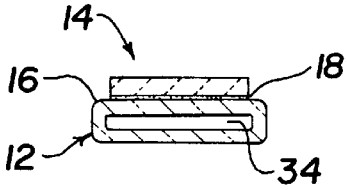
FIG. 5 is a cross section through the structure of FIG. 1 along the lines 5—5 showing the condition of the low cost dispensing device before the voltage pulses are applied to the electrodes.
Figure 6:
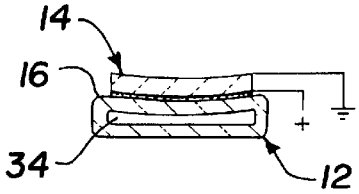
FIG. 6 is the structure of FIG. 5 illustrating one kind of effect the application of voltage pulses will have during the process of generating pressure waves which cause droplets to be dispensed.

FIG. 4 schematically illustrates the orifice 20 which is formed in the wall 30 of capillary tube 12. The outside of the wall is shown in plan view as an oval shape 32 which illustrates the small diameter of the oval shaped orifice 20. The oval shaped orifice results from the fact that the capillary tube is stretched out from a rectangular cross section, although various techniques can produce nearly a round orifice and the exact shape of the orifice is an incidental effect of the use of a rectangular capillary tube. FIG. 5 shows a cross section of the capillary tube with the piezoelectric strip 14 bonded on flat side 16 by means of adhesive layer 18. The capillary tube 12 has an internal fluid-containing chamber 34 which runs down its length to the orifice. Chamber 34 may be a self-contained reservoir for the fluid or may be connected in fluid communication with a separate reservoir. FIG. 6 illustrates that cyclical voltage pulses applied to electrodes 22 produce distortion and acoustic phenomena in chamber 34 which cause droplets of the fluid from chamber 34 to be dispensed.

Figure 7:
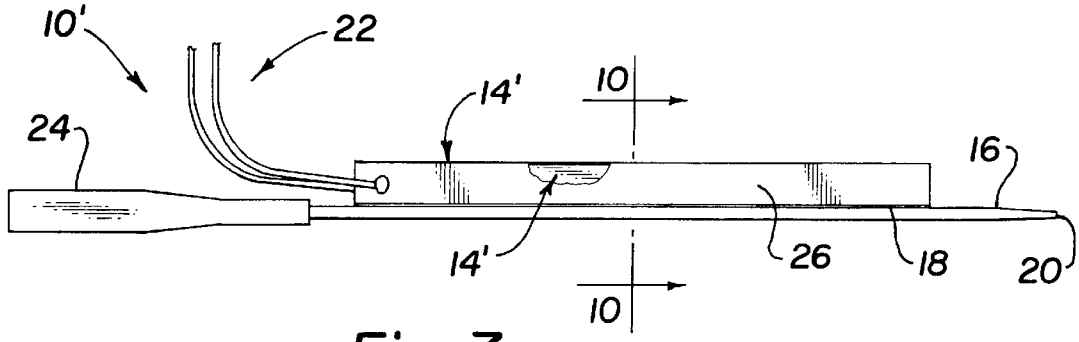
FIG. 7 illustrates a second embodiment of the invention in which a flat strip of piezoelectric material is edge mounted perpendicular to the flat surface of the capillary.
Figure 8:
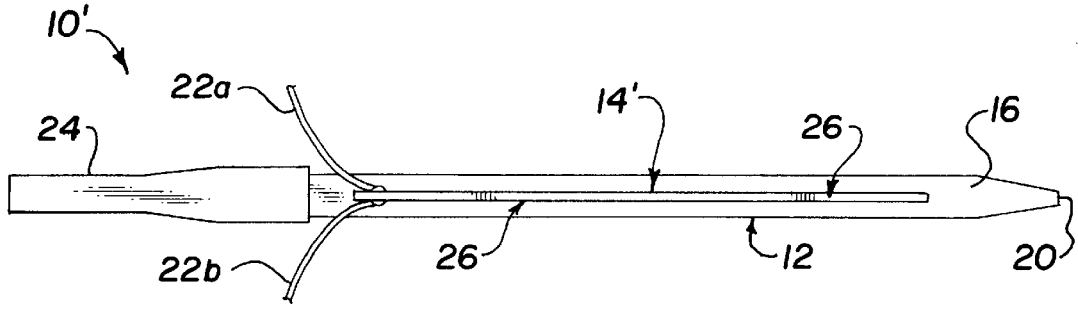
FIG. 8 is a top plan view of the edge mounted structure of FIG. 7.

FIG. 7 shows an alternate embodiment 10' of the low cost dispenser similar in all respects to the embodiment of FIGS. 1–6 except that the flat elongated strip of piezoelectric material 14' is edge mounted to flat surface 16 of flat sided capillary tube 12. The electrically conductive coatings 26 are continuous on each of the opposite sides but insulated from each other by the piezoelectric strip itself. The bottom edge of strip 14' is fastened to flat surface 16 by means of adhesive layer 18. As seen in FIG. 8, piezoelectric strip 14' differs slightly from piezoelectric strip 14 in that the conductive coating 26, (represented by the vertical shading on both opposite surfaces as in FIG. 7) is connected electrically by means of leads 22*a* and 22*b*. Since the material itself is not conductive and the opposite ends are free of conductive coating, a voltage can be applied across piezoelectric strip 14' by applying voltage to each side 26 through leads 22*a* and 22*b*.

Figure 10:
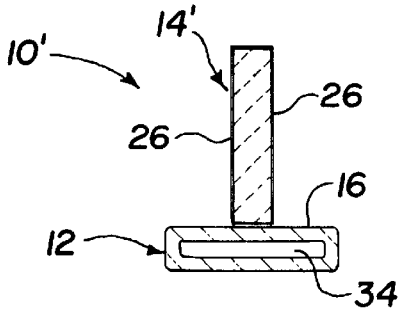
FIG. 10 is a cross section on the lines 10—10 of FIG. 1 showing the structure in its inactivated condition before any voltage pulses are applied.
Figure 11:
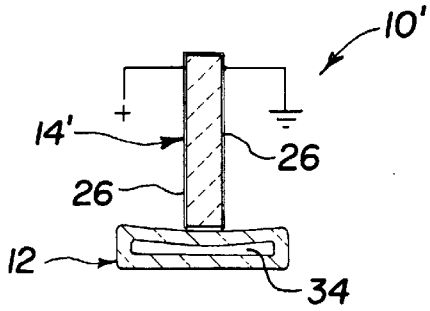
FIG. 11 is the structure of FIG. 10 illustrating the process of generating pressure waves within liquid contained in the rectangular capillary tube which leads to droplet dispensing as electrical voltage pulses are applied.

FIG. 10 illustrates a cross section of the combination of FIG. 7 in the inactive state and FIG. 11 illustrates the same structure in the active state wherein a voltage pulse applied to the coatings 26 on the opposite side surfaces of strip 14' causes dimensional changes in the piezoelectrical material which affects the liquid in the capillary tube such that droplets of liquid are dispensed from orifice 20 in response to cyclically applied voltage pulses. It is believed that the piezoelectric material expands in the vertical dimension of FIG. 11 so rapidly that distortions are caused in the capillary tube on which it is mounted.

Figure 9:
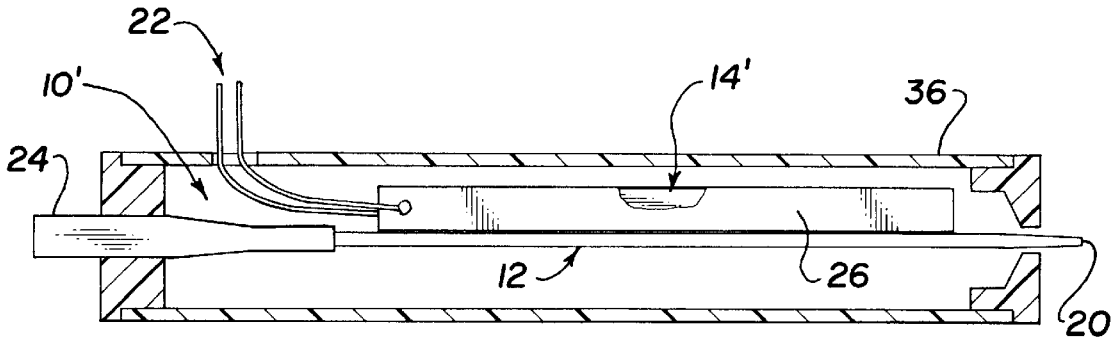
FIG. 9 is a cut away view of the second embodiment of FIGS. 7 and 8 mounted within a protective housing.

FIG. 9 illustrates how low cost dispensing device 10' can be mounted in a protective housing 36 with only an opening for a pair of leads 22 and connection 24. Connection 24 can be supplanted with a reservoir to make this a completely self-contained device. Because of its low cost, the entire dispensing device can be utilized until the fluid is gone, and then discarded.

Figure 12:
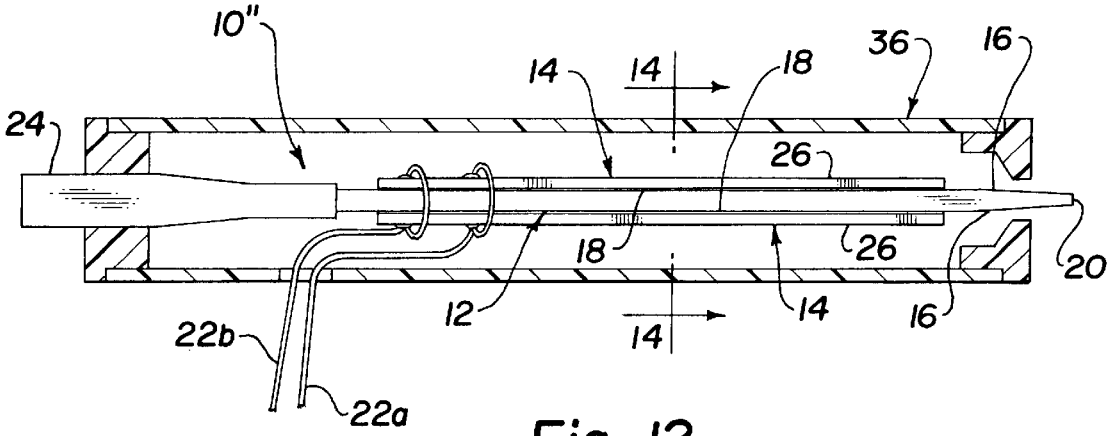
FIG. 12 represents a third embodiment of the invention which is similar to FIG. 1 except that a flat strip of piezoelectric material is bonded to two flat sides of the capillary tube and the structure is contained in the protective housing like FIG. 9.
Figure 13:
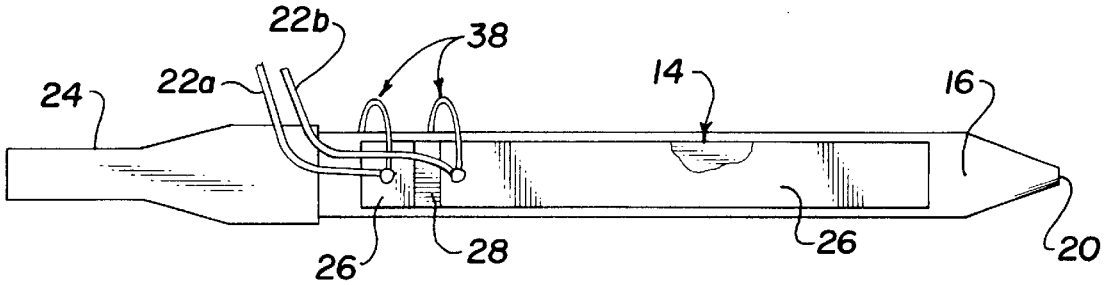
FIG. 13 is a top plan view of the structure of FIG. 12 without the external housing.
Figure 14:
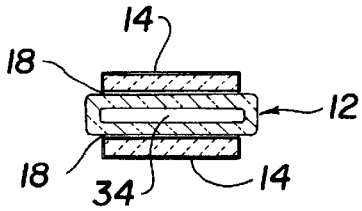
FIG. 14 is a cross section (without the housing) of the embodiment of FIG. 12 on the lines 14—14, showing the structure in the inactivated condition.

FIGS. 12, 13 and 14 illustrate an alternate form 10" of the device of FIGS. 1–6 with or without protective housing 36. In this embodiment, a flat strip 14 of piezoelectric material is attached to each of opposite flat sides 16 of flat-sided capillary tube 12. Low cost dispenser 10" may be mounted inside protective housing 34 in the manner of FIG. 9. A cross section of dispenser 10" is shown in FIG. 14 in the neutral inactive state. When activated, structure 10" would be distorted in a manner similar to that of FIG. 6, from both sides.

FIGS. 12 and 13 show how electrodes 22*a* and 22*b* are jumped by means of jumpers 38 so that voltage is simultaneously applied to each of the piezoelectric strips 14 in the same manner as the single strip in FIG. 1. The conductive coating 26 for the electrodes is the same as that for the single device of FIGS. 1–3. Although the double or twin low cost dispensing device 10" requires the use of twice as much of the piezoelectric material, it has the advantage that it is more efficient electrically and can dispense droplets from orifice 20 at lower pulse voltages than can the single device of FIG. 1.

Figure 16:
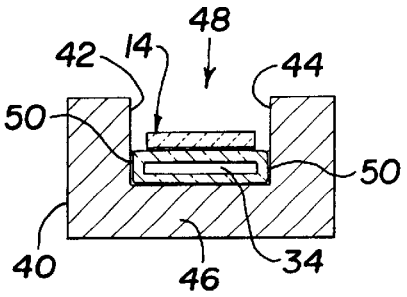
FIGS. 16 and 17 are representative cross sections respectively of a "U"-shaped rigid fixture and a cylindrical rigid fixture which may be utilized in the combination of FIG. 15.
Figure 15:
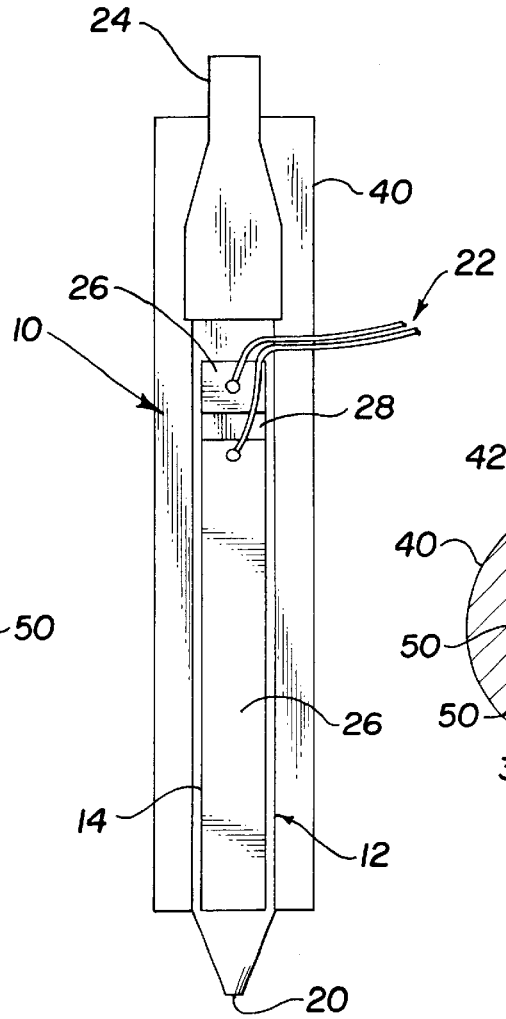
FIG. 15 shows the first embodiment of FIG. 1 mounted in an open sided rigid fixture which improve efficiency.
Figure 17:
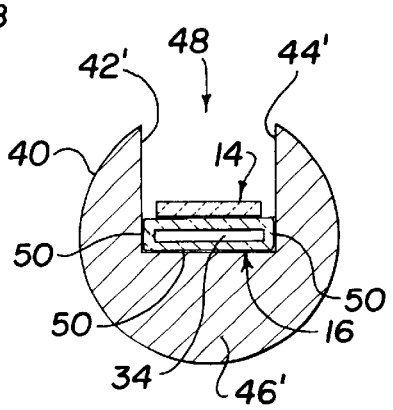

FIGS. 15–17 illustrate another improvement for the low cost-dispensing device 10 of FIGS. 1–6. It has been discovered that if the dispensing device 10 is mounted in a rigid open sided fixture 40, an additional efficiency is obtained which permits operation with lower pulse voltages. As incidental improvements, it also provides protection and increases the operating stability of the device. Fixture 40 is an open sided rigid fixture which may have a rectangular shape as in FIG. 16 or a cylindrical shape as in FIG. 17. In either case, it has three closed sides 42, 44, 46 or 42', 44' and 46'. Both forms of the fixture have an open side 48. The piezoelectric strip 14 faces open side 48. The lower flat side 16 of flat sided capillary tube 16 is preferably mounted with adhesive 50 at the bottom and sides to the fixture 40, 40'.

Figure 18:
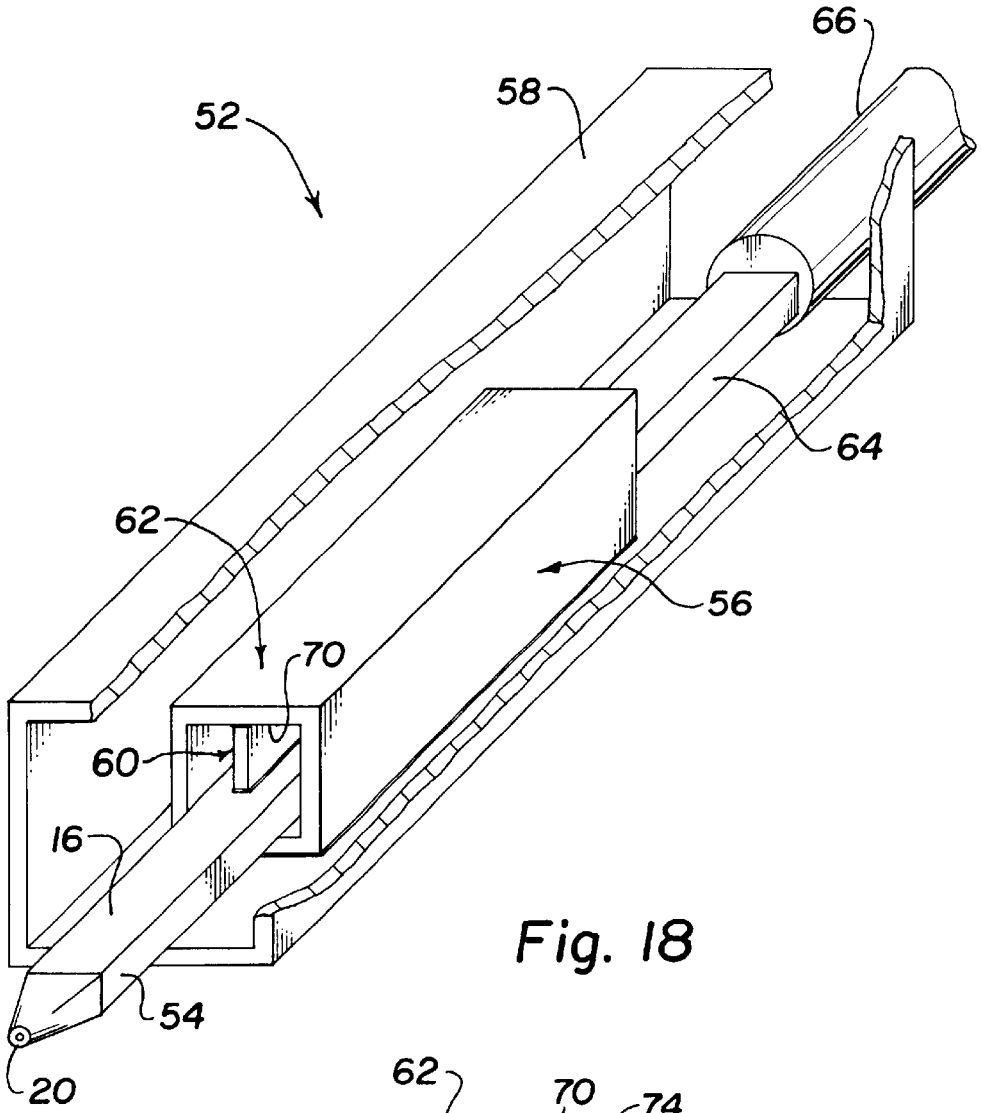
FIG. 18 is a cut away perspective view of a dispenser like the one in FIG. 7 wherein the dispenser edge is mounted on a rectangular glass tube within an inner capsule with the upper edge of the piezoelectric material backed by the capsule wall, in an outer protective housing.

FIG. 18 represents an alternate embodiment 52 in which a flat sided rectangular capillary tube 54 having a dispensing orifice 20 is fixedly mounted within an inner capsule 56 and covered by a protective tube 58. A strip of piezoelectric material 60, like that shown in FIGS. 7 and 8, is fixed in place between a flat surface 16 of the capillary and the inner side 70 of upper wall 62 of inner capsule 56. A rear portion 64 of capillary tube 54 is connected to a feed tube 66 which may be connected in fluid communication with a fluid reservoir (not shown). Tube 66 provides fluid that enters a chamber in the interior of rectangular capillary tube 54. This fluid is dispensed through operation of electrodes and a control system, like the other embodiments, which are omitted in FIGS. 18 and 19. The structure may be best understood by reference to FIG. 19.

Figure 19:
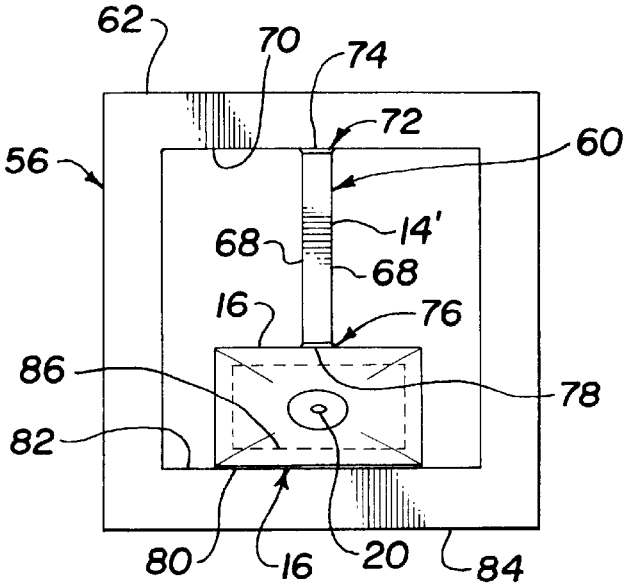
FIG. 19 is a view from the front of FIG. 18 showing the inner capsule, the piezoelectric actuator and the flat sided tube without showing the protective housing.

FIG. 19 is a front view showing only the configuration of the rectangular capillary tube 54, the inner capsule 56 and the piezoelectric strip 60. Piezoelectric strip 60 is like strip 14' in FIGS. 7 and 8 having an electrically conductive coating on the opposite longitudinal sides running along the length and including electrodes 22 (not shown) connecting each of the opposite sides 68. The upper wall 62 of inner capsule 56 has an inner surface 70 to which the upper side edge 72 of piezoelectric strip 60 is bonded by means of adhesive 74. Similarly, the lower side edge 76 of piezoelectric strip 60 is bonded by means of adhesive 78 to upper side 16 of rectangular capillary tube 54. The opposite side 16 of capillary tube 54 is bonded by an adhesive layer 80 to the inside surface 82 of bottom wall 84 which is represented on the inside by the dotted lines 86.

FIG. 20 discloses yet another embodiment which employs a fixture 88 having spaced apart opposing support surfaces 90, 92. A flat-sided capillary tube 94 having an orifice 20 at one end is at least partly supportingly disposed on support surface 90 of fixture 88. Flat-sided capillary tube 94 is an elongated tube like previously described tube 12 or rectangular capillary tube 54, as shown in FIGS. 18 and 19. Its length extends perpendicular to the plane of the paper. One flat side 16 is supported on surface 90. Surfaces 90 and 92 are also elongated in the plane of the paper. The interior of capillary tube 94 comprises an elongated fluid chamber 96, which as before may be a self-contained chamber or it can be supplied from a connected reservoir. Chamber 96 will contain a liquid to be dispensed from the capillary tube 94 through orifice 20.

An elongated strip of piezoelectric material 98, elongated in the direction of the paper, is coupled between the upper flat side 16 of capillary tube 94 and upper support surface 92 of fixture 98 by means of a stand-off strip portion 100 which also extends the plane of the paper. Lower end 102 of stand-off 100 is preferably adhesively connected along its lower edge 102 by means of adhesive 104. Its upper edge 106 is preferably connected by means of adhesive 104 to the lower edge 105 of piezoelectric strip 98. The upper edge of piezoelectric strip 98 is preferably joined to surface 92 by means of another band of adhesive 104. The dotted circle 108 represents a furnace or heating chamber. A pair of electrodes 22 are connected to the conductive coatings 26 running down the length of piezoelectric strip 98 to supply the voltage pulses necessary to activate piezoelectric strip 98 in order to dispense droplets of fluid from orifice 20. Stand-off strip 100 should be considered inert as far as voltage pulses and activity are concerned. It merely serves to transmit mechanical distortions produced in piezoelectric strip 98 by voltage pulses from electrodes 22 into mechanical distortions of flat-sided capillary tube 94. Stand-off strip 100 might preferably be a nonconductor of heat so that excessive heat is not transmitted to piezoelectric strip 98, as it is known that excessive temperature can result in degradation of the piezoelectric material. Piezoelectric material is "poled" by applying a voltage over time at an elevated temperature. If it is exposed to too high a temperature, it can be "depoled" and thus rendered unusable. Therefore, this arrangement allows a fluid dispenser to operate at elevated temperatures without exposing the active piezoelectric material in strip 98 to those elevated temperatures.

FIG. 21 represents a sheet of piezoelectric stock 110, which as mentioned is much less expensive than tubular piezoelectric material. Piezoelectric stock 110 is completely covered on all surfaces with the conductive coating 26. This includes all edges as well as all surfaces. A stock portion 114 is severed on cut line 112. It is easily seen that similar stock portions can be cut from stock 110. Lower end 102 of stand-off 100 is preferably adhesively connected along its lower edge 102 by means of adhesive 104. Its upper edge 106 is preferably connected by means of adhesive 104 to the lower edge 105 of piezoelectric strip 98. The upper edge of piezoelectric strip 98 is preferably joined to surface 92 by means of another band of adhesive 104. The dotted circle 108 represents a furnace or heating chamber. A pair of electrodes 22 are connected to the conductive coatings 26 running down the length of piezoelectric strip 98 to supply the voltage pulses necessary to activate piezoelectric strip 98 in order to dispense droplets of fluid from orifice 20. Stand-off strip 100 should be considered inert as far as voltage pulses and activity are concerned. It merely serves to transmit mechanical distortions produced in piezoelectric strip 98 by voltage pulses from electrodes 22 into mechanical distortions of flat-sided capillary tube 94. Stand-off strip 100 might preferably be a nonconductor of heat so that excessive heat is not transmitted to piezoelectric strip 98, as it is known that excessive temperature can result in degradation of the piezoelectric material. Piezoelectric material is "poled" by applying a voltage over time at an elevated temperature. If it is exposed to too high a temperature, it can be "depoled" and thus rendered unusable. Therefore, this arrangement allows a fluid dispenser to operate at elevated temperatures without exposing the active piezoelectric material in strip 98 to those elevated temperatures.

FIG. 1 represents a sheet of piezoelectric stock 110, which as mentioned is much less expensive than tubular piezoelectric material. Piezoelectric stock 110 is completely covered on all surfaces with the conductive coating 26. This includes all edges as well as all surfaces. A stock portion 114 is severed on cut line 112. It is easily seen that similar stock portions can be cut from stock 110.

Figure 3:
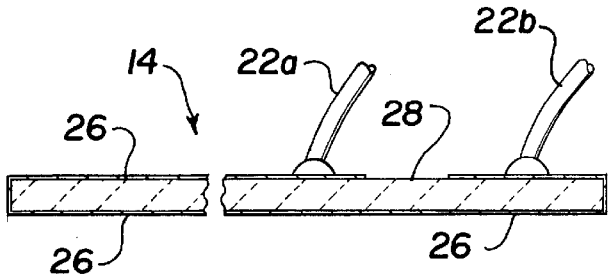
FIG. 3 is a cross section through the flat strip of piezoelectric material of FIGS. 1 and 2 showing the arrangement of the electrodes and the conductive coating which energizes the piezoelectric material.

FIG. 22 indicates the next series of steps in the process of producing the piezoelectric strips. First, a strip 116 of conductive coating 26 is removed by any suitable process. One way to remove the strip is by masking and sand blasting. Opposite end portions are severed away on cut lines 118. In FIG. 23, it is seen that the conductive coating on stock portion 114 wraps around the upper and lower surfaces and the opposite end portions except that the ends are separated by the portion 116 where the coating was removed. The final preparation in FIG. 24 of individual elongated flat piezoelectric strips of the type shown in FIGS. 1–3 is the severing of the individual elongated strips 14 along cut lines 120 to make multiple pieces from strip stock portion 114. This configuration permits both electrodes 22*a*, 22*b*, to be placed on one side surface but the electrical contact is made to both side surfaces of the piezoelectric material.

In operation the connection or sleeve 24 is coupled to a supply of fluid to be dispensed. Alternately, capillary 14 could be filled with fluid and closed at the end or attached to a separate reservoir containing the dispensing fluid, as a self-contained unit. Such an arrangement might be advantageous for a throwaway dispenser that was attached to a greeting card to dispense perfume, for example. Another example might be a disposable pot mounted dispenser which periodically dispensed small quantities of an insecticide. It is even conceivable that a small reservoir attached to the capillary tube could have a puncturable seal which would allow refilling with a syringe.

The electrodes 22 are connected to drive electronics which can be made in the form of a small "chip" as part of a disposable unit powered by a small disposable battery. The drive electronics for piezoelectric dispensers are well known, especially in the field of ink jet printing. The overall length of the device 10, 10', 10" may be an inch or less. The driving electronics may have programmable instructions which include a clock or counter which can generate periodic bursts of dispensed droplets. The driving electronics and battery can be easily contained within a housing such as that found in FIGS. 9 or 12. Very small packages can be produced to make self-contained devices. With a specific design of a low cost dispensing device as shown in FIGS. 1–17, or in the other Figures, it is not difficult to determine the voltage intensity (height of voltage wave) and duration (voltage rise, dwell and fall time) to enable consistent and reliable operation. The effects of the application of various types of voltage pulses are believed well known in the art.

In the best mode, the flat-sided capillary tube is a rectangular cylinder with one end drawn into an oval shaped or nearly round shaped orifice. Flat-sided capillary tube should be considered as including an arcuate walled tube with one flat side. Such a tube could be made, for example, by supporting around glass tube in a fixture having a semi-hemispherical hollow, heating the combined structure and flattening the upper surface of the formerly round (cylindrical) tube. A square flat sided capillary tube is also contemplated but the square design is believed to be less desirable because it is most efficiently operated with a strip of piezoelectric material bonded to each of the four flat surfaces in order to produce microdroplets most effectively at reasonable pulse voltages. This tends somewhat to defeat the purpose of the device as an ultra-low cost assembly which allows for disposable micro dispensers. The square tube can be operated with piezoelectric strips bonded to 1, 2, 3 or 4 sides. The required pulse voltage to operate a square tube device is highest with only one piezoelectric strip and lowest with four piezoelectric strips, one on each flat side.

Some idea of the improvement can be gained by considering that piezoelectric (PZT) tubes which are currently fabricated by methods such as extruding, machining, or molding, etc. may have a cost of $20. Otherwise identical PZT material can be obtained in small flat sheets at a much lower price which permits a working device to be made for only about 2.5% of the cost of the equivalent counterpart PZT tube. In addition, a less expensive paste type adhesive can be used to bond the piezoelectric strip to the capillary tube. This is not possible with the cylindrical form of PZT for it requires a low viscosity adhesive which can enter and fill the very small space between the cylindrical glass capillary tube and the cylindrical PZT tube.

The preferred capillary tube is glass because it is inexpensive and inert. It is believed that the capillary tube could be a thin metal tube with an insert orifice or even a plastic tube if hard enough. Although the rectangular tube is more expensive than the conventional cylindrical glass tube, it is such a small cost compared to cost of the piezoelectric material as to be a non-issue in most applications.

The following Table 1 lists some of the dimensions of the capillary tube and PZT strip, which were used successfully to make a miniature low cost dispenser.

TABLE 1

| | Dimension | First Embodiment | Second Embodiment |
|---|---|---|---|
| Capillary | I.D. (in) | 0.040 × 0.004 | 0.080 × 0.008 |
| | Aspect Ratio | 10:1 | 10:1 |
| | O.D. (in) | 0.048 × 0.012 | 0.096 × 0.024 |
| | Wall Thickness (in) | 0.004 | 0.008 |
| | Length (in) | 0.98 | 0.85 |
| PZT Strip | Length (in) | 0.72 | 0.60 |
| | Width (in) | 0.041 | 0.060 |
| | Thickness (in) | 0.010 | 0.010 |
| | Active length (in) | 0.63 | 0.51 |
| Device | Total length (in) | 1.16 | 1.03 |

The length of capillary tube and the corresponding length of the PZT plates are allowed to vary, but a short length results in a smaller active area of the PZT, and therefore, a higher driving voltage and operation. Rectangular capillary tubes with aspect ratios of 1:10 and 1:1 have been used in prototyping. When the ratio is 1:1, the rectangular capillary becomes a square one.

The orifice diameter of a conventional device with annular geometry is normally within the range of 10 to 100 micrometers. Out of this range, the device may have poorer performance or may be difficult to operate. The corresponding orifice area is thus in the range of $8\times10$ to $8\times10^3$ $\mu m^2$, according to the relationship $A=(\pi/4).d^2$, where A is the area and d is the diameter.

In the rectangular structure, the orifice cut at the drawn taper is in a shape of an ellipse, because of the geometry of the original glass tube. The aspect ratio of the ellipse, i.e. the length ratio of the major axis a to the minor axis b, is preferably controlled within the range of 4:1 to 1:1. At the lower limit of 1:1, the ellipse evolves to a circle.

The area of the ellipse is related to its two axes in the way of $A=(\pi/4).a.b$. Elliptical orifices can be prepared with an area comparable to circular tube devices, i.e. also in the range of $8\times10$ to $8\times10^3$ $\mu m^2$. A typical orifice for the current application may have an "a" of 70 $\mu$m, a "b" of 45 $\mu$m and an "A" of about $2.5\times10^3$ $\mu m^2$.

PZT is "poled" before it is bound to the capillary. Isopropanol alcohol (IPA) and water have been used as dispensing fluids. In operation, the driving pulse is a simple trapezoidal pulse. For IPA dispensing, the rise time and fall time of the pulse are both set as 5 microseconds ($\mu$s). For water dispensing, the rise time and fall time of the pulse are both set as 3 $\mu$s. Firstly, the pulse width is adjusted to obtain a maximum drop velocity, then the pulse height is adjusted to obtain drop velocity of 3 m/sec for IPA dispensing and 2 m/sec for water dispensing. Stable dispensing is realized for both fluids, IPA and water. Typical data for IPA dispensing are: pulse height 30V, pulse width 45 μs; typical data for water dispensing are: pulse height 40V, pulse width 25 μs. These test results prove that the performance of the devices with the new design resemble that of the conventional design closely.

We claim:

1. A method of operating a low cost dispensing device, comprising the steps of:

providing a dispensing device having a capillary tube having flat sides and a strip of piezoelectric material in operative contact with a flat side of the capillary tube, the capillary tube having an orifice and dispensing liquid to be dispensed;

applying cyclical voltage pulses to the piezoelectric strip, of an intensity and duration sufficient to dispense droplets of dispensing liquid from the orifice.

2. The method of operating the low cost dispensing device of claim 1 comprising the steps of:

providing said dispensing device with said strip of piezoelectric material edge mounted along one edge of the piezoelectric material generally perpendicular to said flat side of the capillary tube material wherein said strip of piezoelectric material has a free edge opposite the mounted edge; and restraining said free edge while applying said cyclical voltage pulses to the piezoelectric strip.

3. The method of operating the low cost dispensing device of claim 1 comprising the steps of:

mounting the capillary tube in a rigid fixture along a substantial portion of the length of the capillary tube; and applying said cyclical voltage pulses while said capillary tube is mounted in the rigid fixture.

4. The method of operating the low cost dispensing device of claim 1 comprising the steps of:

providing a fixture having spaced apart support surfaces; and mounting said capillary tube on one of said support surfaces with said piezoelectric strip being restrained by the other of said support surfaces before applying said cyclical voltage pulses to the piezoelectric strip.

5. The method of operating a low cost dispensing device of claim 4 where the step of providing a flat-sided capillary tube is accomplished by providing said tube having a rectangular cross section.

6. The method of operating a low cost dispensing device of claim 1 comprising the steps of:

providing a fixture having spaced apart support surfaces;

mounting the flat-sided capillary tube on one of the support surfaces of the fixture;

the step of providing a strip of piezoelectric material in operative contact with a flat side of said tube is performed by providing a stand-off strip in contact with the flat side of the capillary tube, between the piezoelectric strip and the other support surface of the fixture and supporting the piezoelectric strip by said other supporting surface of the fixture whereby action produced by applying cyclical voltage pulses to said piezoelectric strip is transferred to said capillary tube by said stand-off strip.

7. A low cost dispensing device, comprising:

a capillary tube having flat sides and having an orifice at one end;

a liquid to be dispensed from the capillary tube, a portion of said liquid being in fluid communication with the orifice;

an elongated strip of piezoelectric material bonded to a flat side of the capillary tube; and connection for drive electronics whereby a series of voltage pulses can be cyclically applied to the piezoelectric material thereby causing dimensional changes in the piezoelectric material which affect the liquid in the capillary tube such that droplets of said liquid are dispensed from the orifice of the capillary tube in response to the cyclically applied voltage pulses.

8. The dispensing device of claim 7 wherein the strip of piezoelectric material lies generally parallel to a flat side of the capillary tube.

9. The dispensing device of claim 8 wherein the flat-sided capillary tube has a rectangular configuration.

10. The dispensing device of claim 7 wherein the strip of piezoelectric material lies generally perpendicular to a flat side of the capillary tube.

11. The dispensing device of claim 10 wherein the flat-sided capillary tube has a rectangular configuration.

12. The dispensing device of claim 7 wherein the capillary tube is supported in a rigid fixture along a side opposite the elongated strip of piezoelectric material.

13. The dispensing device of claim 12 wherein the supported side of the capillary tube is fixedly supported in the rigid fixture.

14. The dispensing device of claim 13 wherein the flat-sided capillary tube has a rectangular configuration.

15. The dispensing device of claim 12 wherein the flat-sided capillary tube has a rectangular configuration.

16. The dispensing device of claim 7 wherein the capillary tube is supported along a side below the strip of piezoelectric material by a rigid fixture.

17. The dispensing device of claim 16 wherein the supported side of the capillary tube is fixedly supported in the rigid fixture.

18. The dispensing device of claim 17 wherein the flat-sided capillary tube has a rectangular configuration.

19. The dispensing device of claim 16 wherein the flat-sided capillary tube has a rectangular configuration.

20. The dispensing device of claim 7 wherein the flat-sided capillary tube has a rectangular configuration.

21. A low cost dispensing device, comprising:

a fixture having spaced-apart opposing support surfaces;

a capillary tube having flat sides and having an orifice at one end, the capillary tube being at least partly supportingly disposed on one support surface of the fixture;

a liquid to be dispensed from the capillary tube through the capillary tube orifice;

a strip of piezoelectric material coupled between the other of the support surfaces of the fixture and a flat side of the capillary tube in a configuration suitable for causing droplets of said liquid to be ejected from the orifice in response to the application of voltage pulses to the piezoelectric material; and connection for drive electronics capable of generating and transmitting said voltage pulses to be electrically connected to said piezoelectric material in order to dispense droplets of said liquid from said orifice.

22. The dispensing device of claim 21 wherein said fixture is an elongated closed sided fixture.

23. The dispensing device of claim 21 wherein the strip of piezoelectric material includes a stand-off strip portion having one edge connected to the piezoelectric strip and an opposite edge coupled to the flat side of the capillary tube to permit operation of the capillary tube at elevated temperature without depoling the piezoelectric material.

24. A method of constructing a low cost liquid dispensing device of the type having a capillary tube, with a dispensing orifice, wherein the capillary tube is in intimate contact over an extended portion of its length with a piezoelectric actuator connected to drive electronics and a power supply capable of operating the piezoelectric actuator by means of cyclical voltage pulses of sufficient intensity and duration comprising:

providing the capillary tube as a tube having flat sides;

providing the piezoelectric actuator as a flat strip of piezoelectric material having a conductive coating;

bonding the flat strip of piezoelectric material to a flat side of the capillary tube; and providing electrical contacts to the conductive coating on the piezoelectric material whereby droplets of dispensing liquid may be dispensed from said orifice in response to application of said voltage pulses to said piezoelectric material.

25. The method of constructing a low cost liquid dispensing device of claim 24, further comprising the steps of:

cutting the flat strip of piezoelectric material from a larger sheet of said piezoelectric material.

26. The method of claim 25 further comprising the steps of:

providing said larger sheet with an electrically conductive coating layer which will serve as a basis for attachment of electrode wires to operate the device after said flat strip is cut from the said sheet.

27. The method of claim 26 further comprising the steps of:

cutting the larger strip of piezoelectric material to produce an intermediate long flat strip of piezoelectric material having said electrically conductive coating;

removing a portion of said electrically conducted coating; and selecting the flat strip of piezoelectric material from a plurality of said flat strips of piezoelectric material, one of which is the piezoelectric operator, by cross cutting them from the intermediate long flat strip.

28. The method of claim 24 further comprising the steps of:

providing a "U"-shaped support for the capillary tube; and fixing the capillary tube to the "U"-shaped support, whereby dispensing liquid droplets are dispensed by means of voltage pulses which are of a lower voltage than would be required to achieve the same drop velocity absent the "U"-shaped support.

29. The method of claim 28 further comprising the steps of:

the step of providing a "U"-shaped support is performed by providing the "U"-shaped support as an elongated support having closed side portions; and mounting the flat strip of piezoelectric material so it is not restrained by the closed side portions of the "U"-shaped support.

30. The method of claim 24 further comprising the steps of:

bonding the flat strip of piezoelectric material to a flat side of the capillary tube in a perpendicular orientation to said tube.

31. The method of claim 30 further comprising the steps of:

mounting the capillary tube and piezoelectric actuator in an elongated fixture having first and second walls, in such a manner that the first wall of the fixture supports the capillary tube on the side opposite the piezoelectric actuator while the piezoelectric actuator is simultaneously restrained from movement by the second wall of the fixture.

32. The method of claim 24 further comprising the steps of:

providing the tube as having a rectangular cross section.

33. The method of claim 24 further comprising the steps of:

providing the tube as having a generally square cross section.

* * * * *